US005345899A

United States Patent [19]

Boyer et al.

[11] Patent Number: 5,345,899

[45] Date of Patent: Sep. 13, 1994

[54] IGNITION DISTRIBUTOR DRIVE

[75] Inventors: James A. Boyer; Richard E. Ballentine, both of Anderson, Ind.

[73] Assignee: General Motors Corporation, Detroit, Mich.

[21] Appl. No.: 112,022

[22] Filed: Aug. 26, 1993

[51] Int. Cl.[5] ..... F02P 7/02

[52] U.S. Cl. ..... 123/146.5 A

[58] Field of Search ..... 123/146.5 A; 200/19 R, 200/19 DC, 19 DR

[56] References Cited

U.S. PATENT DOCUMENTS

| | | | |
|---|---|---|---|
| 3,577,970 | 5/1971 | King et al. | 123/146.5 A |
| 4,454,856 | 6/1984 | Fox et al. | 123/146.5 A |
| 4,619,227 | 10/1986 | Kapfer et al. | 123/146.5 A |
| 4,869,216 | 9/1989 | Ushida et al. | 123/146.5 A |
| 5,028,747 | 7/1991 | Ballentine et al. | 200/19 DC |

FOREIGN PATENT DOCUMENTS

| | | | |
|---|---|---|---|
| 3109606 | 10/1982 | Fed. Rep. of Germany | 123/146.5 A |
| 3830900 | 3/1990 | Fed. Rep. of Germany | 123/146.5 A |

*Primary Examiner*—David A. Okonsky
*Attorney, Agent, or Firm*—Michael J. Bridges

[57] ABSTRACT

An ignition distributor where the rotor of the distributor is driven by the camshaft of an internal combustion engine. The end of the camshaft has an axially extending bore. The ignition distributor has a coupling. The coupling has an axially extending shaft portion that is located in the bore of the camshaft. The coupling has a laterally extending portion that has a radially extending slot. The camshaft carries a drive pin. One end of the drive pin is located in the slot with the pin engaging internal side wall surfaces of the slot. The pin forms a drive means for driving the coupling from the camshaft. The coupling drives the rotor of the distributor.

4 Claims, 2 Drawing Sheets

IGNITION DISTRIBUTOR DRIVE

This invention relates to an ignition distributor and to a drive connection for driving the rotor of the distributor from the camshaft of a spark-ignited internal combustion engine.

Ignition distributors where the rotor of the distributor is driven by the camshaft of an internal combustion engine are known, one example being the drive arrangement disclosed in the King U.S. Pat. No. 3,577,970.

This invention is concerned with providing a new and improved distributor drive connection between the camshaft of an engine and the distributor rotor.

One of the objects of this invention is to provide a means for driving the rotor of an ignition distributor from the end of a camshaft of an engine with very high fit-up accuracy and freedom from lash in the mating components. This invention minimizes fit-up inaccuracies by piloting on the engine camshaft rather than on the distributor housing. Lash is eliminated by driving a distributor coupling that drives the rotor of the distributor from a pin that is secured to the engine camshaft which has a portion that is disposed within a slot or groove formed in the coupling. The pin has a surfaces that engage side surfaces that define the slot.

More specifically, an ignition distributor and ignition distributor drive made in accordance with this invention comprises a distributor drive coupling that has an axially extending shaft portion. When the ignition distributor is assembled to an internal combustion engine, the shaft portion is inserted into a bore formed in the end of the engine camshaft thereby piloting the coupling on the engine camshaft. The coupling is supported for rotation by a ball bearing that is supported by the base of the distributor. The camshaft is connected to a drive pin and the coupling has a slot or groove which receives one end of the drive pin. This slot or groove extends radially of the coupling. This slot has internal radially extending surfaces or walls that tightly engage opposed surfaces of the pin. The slot extends radially by an amount relative to the diameter of the pin to facilitate the insertion of the pin into the groove.

IN THE DRAWINGS

Figure 1:
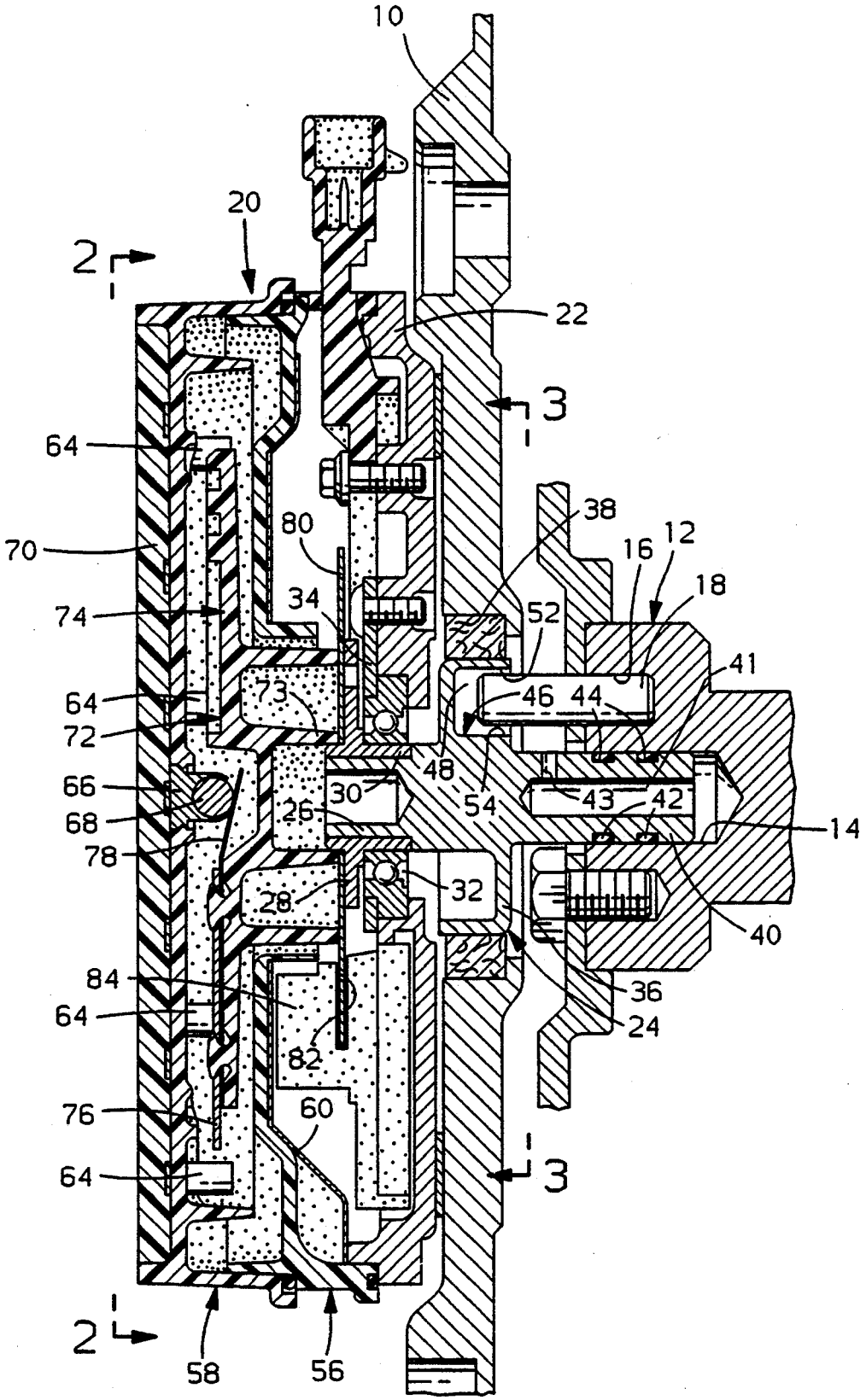
FIG. 1 is a sectional view of an ignition distributor and the end of a camshaft of an engine.
Figure 2:
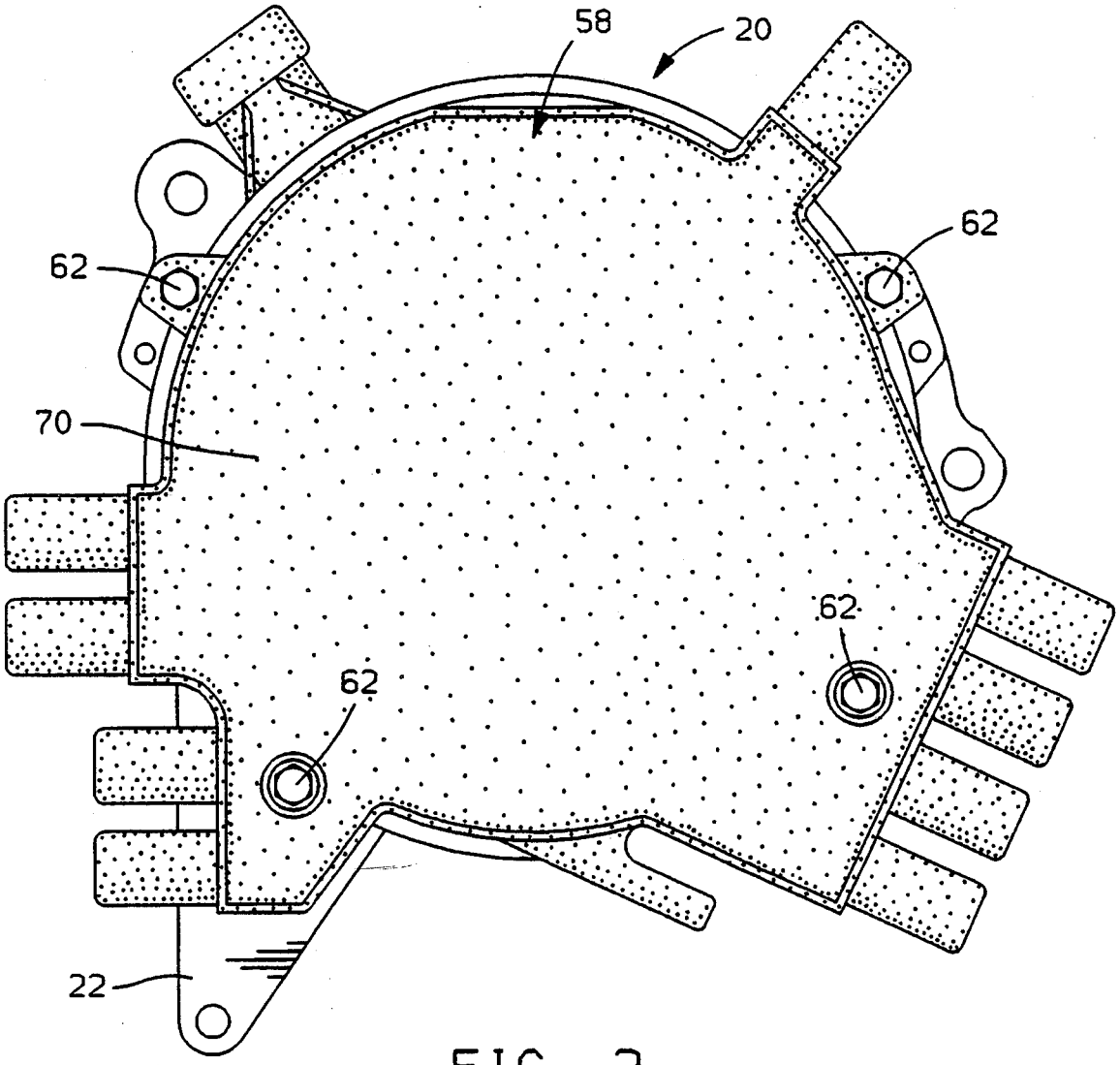
FIG. 2 is a view looking in the direction of arrows 2—2 shown in FIG. 1.

Referring now to the drawings, and more particularly to FIG. 1, the reference numeral 10 designates a wall of the block of a spark ignited internal combustion engine. This engine has a camshaft, one end of which is shown in FIG. 1 and designated as 12. The camshaft 12 has an axially extending cylindrical bore 14. The camshaft 12 further has a cylindrical bore 16. One end of a steel cylindrical drive pin 18 is press-fitted into the bore 16 so that the pin 18 is securely fastened to camshaft 12.

The ignition distributor of this invention is generally designated as 20 and the rotor of the distributor is driven by camshaft 12 in a manner to be described.

The distributor 20 has a metal base member 22 that is fastened to engine wall 10 and has a coupling generally designated as 24. The coupling 24 is formed of powdered metal such as sintered iron. The coupling 24 has a cylindrical portion 26 that carries a metal rotor part 28 that is formed of powdered metal. The metal part 28 is press-fitted to portion 26 of coupling 24 so that part 28 is driven by coupling 24. The part 28 has a cylindrical portion 30 that engages the inner race of a ball bearing 32. The outer race of ball bearing 32 is supported by base 22 and is fixed to base 22 by bearing retainer 34. From what has been described, it can be appreciated that the coupling 24 and part 28 are rotatably supported by base 22.

The coupling 24 has a laterally extending cylindrical portion 36. An outer cylindrical surface of portion 36 engages an oil seal 38 that is disposed between portion 36 and the inner wall of an opening formed in engine wall 10.

The coupling 24 has an axially extending cylindrical shaft portion 40 that extends into the bore 14 formed in camshaft 12. A pair of resilient O-rings 42 that are formed of elastomeric material, such as rubber, are compressed between an inner cylindrical surface defining bore 14 and outer surfaces of shaft portion 40. The O-rings are located in annular grooves 44 formed in shaft portion 40 and they engage inner cylindrical surfaces defining bore 14. The purpose of O-rings 42 is to provide a tight lash-free fit between shaft portion 40 and the inner surface of bore 14. The shaft portion 40 has an axially extending passage 41 connected to a radially extending passage 43. The purpose of these passages is to provide a vent for air that may be compressed when the shaft portion 40 is inserted into bore 14.

The portion 36 of coupling 24 has a radially extending slot or groove 46. One end of drive pin 18 is located in slot 46. The slot 46 has spaced inner side surfaces 48 and 50. The diameter of drive pin 18 and the distance between surfaces 48 and 50 is such that the pin tightly engages these surfaces.

Figure 3:
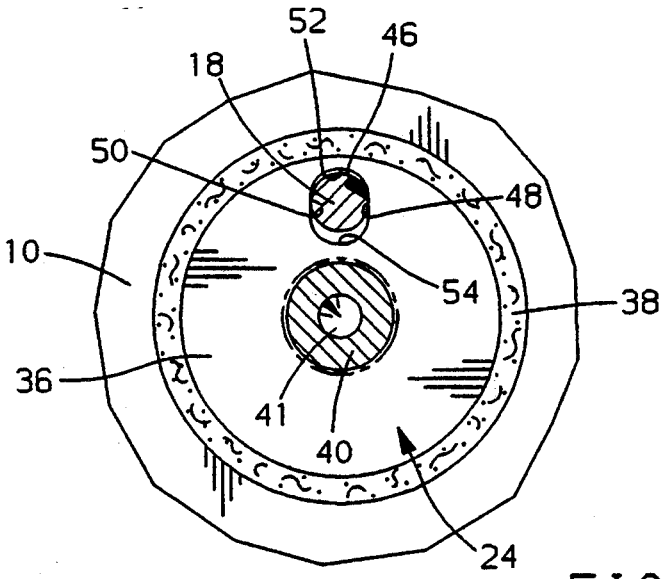
FIG. 3 is a view looking in the direction of arrows 3—3 shown in FIG. 1.

The slot 46 further has spaced inner end surfaces 52 and 54. The diameter of pin 18 and the distance between surfaces 52 and 54 is such that the pin is spaced from surface 52 and is spaced from surface 54 as is shown in FIG. 3. This allows the pin 18 to be inserted into slot 46 even if there is some radial mismatch between pin 18 and slot 46 when the distributor is assembled to the engine.

The distributor cap is comprised of an inner cover 56 and an outer cover or cap 58, both of which are formed of moldable plastic insulating material. The inner cover 56 engages the base 22 and it has an inner electromagnetic shield 60 formed of tin plated steel.

The outer cover 58 engages the inner cover 56 and both covers are secured to base 22 by threaded fasteners 62 that pass through openings in the outer cover 58 and through inner cover 56. The fasteners are threaded into threaded bores formed in base 22.

The cap 58 is like the cap shown in the Ballentine et al., U.S. Pat. No. 5,028,747, granted on Jul. 2, 1991. Thus, the cap has a plurality of circumferentially spaced electrodes, some of which are shown in FIG. 1 and designated as 64. The cap 58 further has a center metallic insert 66 that carries a carbon ball 68. The electrodes are connected to spark plug terminals and an ignition coil terminal by means of ink traces, as disclosed in the above-referenced Ballentine et al. patent. The ink traces are covered by a plastic potting compound designated as 70.

The ignition distributor has a rotor generally designated as 72. This rotor is comprised of a part 74 that is formed of moldable plastic electrical insulating material. Part 74 carries a metallic conductive insert 76, the end of which swings past the inserts 64 when the rotor is rotating. The insert 76 is in contact with a spring contact 78 that engages ball contact 68.

The tubular portion 73 of rotor part 74 has a rib (not illustrated) that fits into a slot (not illustrated) formed in part 28 for rotatably driving part 74 with rotation of part 28 and coupling 24. Further, the part 74 of the rotor is fastened to part 28 by threaded fasteners (not illustrated) that are threaded into threaded holes formed in part 28.

Disposed between parts 74 and 28 is a vane 80 that has a plurality of circumferentially spaced slots or slits. This vane 80 rotates with rotation of coupling 24 and part 28. The vane swings through a slot 82 formed in a sensor 84. This sensor has a source of light such as light-emitting diodes and photo-responsive semiconductor devices located on opposite sides of slot 82. This sensor provides pulses that represent engine camshaft angular position information.

The coupling 24 may be provided with a plastic insert that faces camshaft 12 that would be driven by pin 18. This insert would be an annular part that has a slot, like slot 46, that would receive one end of drive pin 18.

The embodiments of the invention in which an exclusive property or privilege is claimed are defined as follows:

1. A drive for driving the rotor of an ignition distributor from the camshaft of an internal combustion engine, comprising in combination, an engine camshaft, said camshaft having an axially extending bore, an ignition distributor having a base, said ignition distributor having a coupling that is rotatably supported by said base, said coupling having an axially extending shaft portion that is located in said bore, said coupling having a radially extending slot defined by opposed radially extending side surfaces, a drive pin secured to said camshaft, said pin having a portion located in said slot with said pin engaging said side surfaces of said slot, and a rotor for said distributor driven by said coupling.

2. The drive according to claim 1 where said shaft portion has a plurality of axially spaced annular grooves, an O-ring formed of resilient material located in each of said grooves, each O-ring being compressed between an inner surface defining said bore in said camshaft and said shaft portion of said coupling.

3. The drive according to claim 1 where said slot is formed in a laterally extending portion of said coupling, said axially extending shaft portion of said coupling extending in one direction from said laterally extending portion, said coupling having another portion that extends away from said laterally extending portion in a direction opposite to said one direction.

4. An ignition distributor having a rotor that is adapted to be driven by the camshaft of an internal combustion engine comprising, a base, a coupling rotatably supported by said base, said coupling having a laterally extending portion and an integral shaft portion that extends axially from said laterally extending portion, said shaft portion being adapted to be inserted into a bore formed in the camshaft of an internal combustion engine when said distributor is assembled to an engine, said laterally extending portion having a radially extending slot defined by spaced radially extending surfaces, said surfaces being adapted to engage a drive pin secured to said camshaft.

* * * * *